United States Patent [19]

Fradique

[11] Patent Number: 4,596,612

[45] Date of Patent: Jun. 24, 1986

[54] METHOD OF QUENCHING METALS

[75] Inventor: Manuel Fradique, Versoix, Switzerland

[73] Assignee: BP Chemicals Limited, London, England

[21] Appl. No.: 662,818

[22] Filed: Oct. 22, 1984

Related U.S. Application Data

[63] Continuation of Ser. No. 440,576, Nov. 10, 1982, abandoned.

[30] Foreign Application Priority Data

Nov. 11, 1981 [GB] United Kingdom ..... 8134355

[51] Int. Cl.[4] ..... C21D 1/56; C21D 1/60

[52] U.S. Cl. ..... 148/18; 148/19; 148/20.6; 148/28; 148/29; 148/30

[58] Field of Search ..... 148/18, 19, 20.6, 28, 148/29, 30; 252/49.3

[56] References Cited

U.S. PATENT DOCUMENTS 3,374,171 3/1968 Davis et al. ..... 252/49.3

4,177,155 12/1979 Popplewell ..... 252/49.3

FOREIGN PATENT DOCUMENTS 1004259 9/1965 United Kingdom .

1018215 1/1966 United Kingdom .

OTHER PUBLICATIONS

G. Butler and A. D. Mercer, J. Brit, Corrosion, vol. 12, No. 3, pp. 171–174, 1977.

P. M. Blanchard, Metallurgie and Metal Forming, pp. 177–180, Jun. 1973.

*Primary Examiner*—Veronica O'Keefe

*Attorney, Agent, or Firm*—Brooks Haidt Haffner & Delahunty

[57] ABSTRACT

A metal quenchant fluid which is a mixture of water and a polyalkylene glycol and a inhibitor is substantially nitrite free. The inhibitor is a soluble product obtained by mixing a carboxylic acid having 4 to 12 carbon atoms in the molecule, an amine such as an alkanolamine boiling above 150° C. at atmospheric pressure and a copper chelating agent such as NN diethanol methylene benzotriazole.

12 Claims, No Drawings

METHOD OF QUENCHING METALS

This application is a continuation of application Ser. No. 440,576, filed Nov. 10, 1982, and now abandoned.

The present invention relates to a method of quenching heated metal.

It is known to heat-treat metals to alter their physical properties by heating the metals and then quenching them by immersion in, or spraying with cool liquid. A known liquid used for this purpose is a mixture of water and a polyalkylene glycol. The liquid used for the metal treatment process itself, the metal quenchant fluid, usually contains a high proportion of water and is not usually sold to persons carrying out metal treatment as such. Persons carrying out metal treatment usually buy a liquid mixture of water and polyalkylene glycol which has a relatively high concentration of polyalkylene glycol and add addtional water to it. Such liquid mixtures with relatively high polyalkylene glycol concentration will be referred to in this specification as metal quenchant fluid concentrates.

In order to provide protection against corrosion of metal components associated with the apparatus used in the metal quenching process, alkali metal nitrites have been incorporated into the metal quenching fluids. However the presence of alkali metal nitrites is regarded as undesirable by some users of metal quenchant fluids who believe that they may react to form carcinogenic materials or present disposal problems. It is therefore desirable to find an additive or additive combination to replace alkali metal nitrites which will provide satisfactory inhibition of the corrosion of a variety of metals by the metal quenchant fluid. The metal quenching fluid and the concentrate in addition to corrosion inhibiting properties must also possess storage stability i.e. it must not produce deposits during storage or use. It is very difficult to find additives which will meet both these requirements.

The polyalkylene glycol used in the quenchant fluid has an important effect on the cooling characteristics of the quenchant fluid. Under the conditions of use however, the polyalkylene glycol tends to be decomposed by oxidation. It is most desirable to reduce the extent of this decomposition of the polymer.

It is known to use water/ethylene glycol mixtures as engine coolants and various corrosion inhibitor systems are known for use in such engine coolants. Butler and Mercer Br. Corros., 1977, vol. 12, No 3, pp 171–174 disclose that mixtures of sodium sebacate and benzotriazole have a synergistic effect on the corrosion of cast iron.

The problems facing a person seeking an inhibitor system for a metal quenchant fluid are quite different from those facing a person seeking corrosion inhibitors for engine coolants. Metal quenchant liquids unlike engine coolants contain a substantial quantity of polyalkylene glycols which, as stated above, are subject to decomposition in use. As the polyalkylene glycol has a significant effect on the cooling characteristics of the metal quenchant, this decomposition is most undesirable. Furthermore, the nitrite used in the known nitrite-containing metal quenchant fluids has a beneficial effect on the cooling characteristics of the quenchant and any alternative system must not have a substantially adverse effect on the cooling characteristics. Thus disclosures relating to engine coolants are not directly applicable to metal quenchant fluids and an engine coolant will not be a satisfactory metal quenchant fluid.

We have now found a combination of additives which enables an effective inhibitor system for metal quenchant fluids to be provided without the use of nitrites. In particular, the decomposition of the polyalkylene glycol is reduced even though the individual components of the inhibitor system are not themselves oxidation inhibitors.

According to the present invention a metal quenchant fluid which is a mixture of water and a water soluble polyalkylene glycol together with an inhibitor is characterised in that it is substantially nitrite-free and that the inhibitor is a soluble product obtained by mixing a carboxylic acid having 4 to 12 carbon atoms in the molecule, an amine which gives a soluble salt with the carboxylic acid, and a copper chelating agent.

The relative amounts of polyethylene glycol-and water employed in the quenchant fluid can be as described in UK Pat. No. 1018215. For example from 0.1 to 30% polyethylene glycol and from 99.9 to 45% wt water based on the wt of the composition can be used.

The polyalkylene glycol may contain $C_2H_4O$ units or $C_3H_6O$ units or mixtures of such units.

The molecular weight of the polyalkylene glycol may for example be in the range 1000 to 25,000 more preferably 10,000 to 20,000.

Desirably the polyalkylene glycol has an inversion temperature at normal atmospheric pressure. The polyalkylene glycol can be any of these described in UK Pat. No. 1018215.

The present invention also provides a concentrate suitable for the preparation of metal quenchant fluids by addition of water.

The weight ratio of water to polyalkylene glycol in the concentrate may be e.g. 25:75 to 75:25, preferably 45:55 to 55:45.

The metal quenchant fluid may be prepared from the concentrate by the addition of water. Examples of suitable quenchant fluids are those prepared by the addition of water to give a concentration of concentrate in the quenchant fluid of 5 to 45% weight/weight of total fluid. For a concentrate containing 50% weight/weight of polyalkylene glycol this corresponds to a polyalkylene glycol concentration in the metal quenchant fluid 2.5% to 22.5% weight/weight.

The carboxylic acid contains from 4 to 12 carbon atoms in the molecule. The acids at the lower end of the range will tend to give less effective corrosion protection. The acids at the higher end of the range will give products with an increased tendency to foam. It is preferred to use carboxylic acids having 8 to 12 carbon atoms in the molecule. The carboxylic acid may for example be an aliphatic carboxylic acid. Alternatively the acid may be aromatic e.g. salicylic acid. The use of poly carboxylic acids (including dicarboxylic acids) is preferred and is it particularly preferred to use sebacic acid (decane dioic acid).

The acid used must not give an insoluble product with the other components of the inhibitor composition. For the purposes of this specification a material is soluble if it soluble at ambient temperature in both the metal quenchant fluid concentrate and in the metal quenchant fluid itself (after a dilution of the concentrate with water).

It is desirable that the amine used should not be excessively volatile under the conditions of use and it is believed that amines with a boiling point over 150° C. at atmospheric pressure will have satisfactory low vapour pressure at the working temperature. The amines which satisfy this condition, which are soluble in the concentrate and quenchant fluid, and commercially available at reasonable prices are generally alkanolamines for example monoisopropanalamine, diethanolamine, triethanolamine, triisopropanolamine.

The copper-chelating agent must give a soluble inhibitor and can be a substituted aromatic triazole, eg one containing one ore more —OH groups which are aliphatically functional. Examples of suitable copper-chelating agents are N,N-(diethanol) methylene benzotriazole and NN diethanol methylene tolutriazole.

The effectiveness of the inhibitor will depend upon the total quantity of the inhibitor used and also on the relative amounts of the ingredients, in particular the relative amounts of carboxylic acid and amine. The relative amounts of carboxylic acid and amine are preferably selected to give a pH in the range 7.5 to 10.0 for a concentration of 10% of fluid concentrate in water.

According to another aspect of the invention a method of quenching a metal comprises contacting the heated metal with an aqueous quenchant fluid containing a soluble polyalkylene glycol and an inhibitor characterised in that the quenchant fluid is substantially nitrite-free and that the inhibitor is a soluble product obtained by mixing a carboxylic acid having 4 to 12 carbon atoms in the molecule, an amine which gives a soluble salt with the carboxylic acid and a copper chelating agent.

The present invention enables metal quenchant fluids to be produced which have good resistance to decomposition of the polyalkylene glycol. It is possible to add further substances which are specifically intended to stabilise the polyalkylene glycol against decomposition. It is however a particular feature of the present invention that it enables metal quenchant fluids to be produced which do not require the presence of an effective amount of an additional polymer stabliser.

EXAMPLE 1

A metal quenchant concentrate was prepared which had the following formulation:

| | % (wt/wt) |
|---|---|
| Polyalkylene glycol A | 50.0 |
| Diethanolamine | 5.0 |
| Sebacic acid | 1.5 |
| N,N—(diethanol) methylene tolutriazole | 0.5 |
| Tap water | 43.0 |

The polyethylene glycol and water were first mixed and the other components added in the order shown.

Polyalkylene glycol A is a copolymer of ethylene oxide (75% wt) and propylene oxide (25% wt) with an inversion temperature of 74° C., a viscosity of 18,000 centistokes at 40° C. and which has an average molecular weight of about 14,000.

A metal quenchant fluid was prepared by making a 10% wt/wt aqueous solution of the concentrate and the stability of the polyalkylene glycol in the quenchant liquid was investigated in a repeat quench test. A bath of the quenchant was maintained at 20° C.-25° C., and a ferrous metal probe maintained at 750° C.-800° C. and inserted 1000 times into the bath. Several repeat experiments were carried out and the pH at the start and end of each test was measured together with the decrease in viscosity of the quenchant fluid. The decrease in viscosity is a measure of the degradation of the polymer.

The results are shown in Table 1.

COMPARATIVE TEST A

A repeat quench test was carried out as in Example 1 on a 10% aqueous solution of a commercially available metal quenchant concentrate which contained potassium nitrite and was based on the same polyalkylene glycol as Example 1. Table 1 shows the results.

TABLE 1

| Experiment | Run | pH before | pH after | Viscosity decrease in % |
|---|---|---|---|---|
| 1 | 1 | 9.4 | 9.1 | 3 |
| 1 | 2 | 9.4 | 9.1 | 8 |
| 1 | 3 | 9.4 | 9.1 | 0 |
| 1 | 4 | 9.4 | 9.2 | 1 |
| 1 | 5 | 9.4 | 9.1 | 3 |
| A | 1 | 8.8 | 8.6 | 7 |
| A | 2 | 8.8 | 8.7 | 21 |
| A | 3 | 8.8 | 8.6 | 14 |
| A | 4 | 8.8 | 8.5 | 8 |
| A | 5 | 8.8 | 8.5 | 12 |

The superior polymer stability provided by the composition of the present invention is clearly shown by the lower viscosity decrease.

EXAMPLE 2

The metal quenchant fluid (10% aqueous solution) used in Example 1 was subjected to a glassware corrosion test.

GLASSWARE CORROSION TEST

The intention of this test is to study the corrosion protection of the metals in contact with the quenchant solution, e.g. quenchant tank, pump, hoses, etc. Since, in practice, all the metals are heat accepting surfaces, it was decided to adopt the ASTM 1384 (Ref. 1) glassware corrosion test to study the corrosion inhibition performances of the candidate formulations.

The test conditions adopted were similar to those of the ASTMD1384.70 glassware corrosion test with the following differences: temperature 70° C., duration 240 h, and a quenchant concentration of 10% by weight which corresponds to a 5% concentration of the polyalkylene glycol. The metals present in the bundle were brass, cast iron, steel and aluminium. At the end of the test the metal specimens were physically and chemically cleaned, according to the procedure described in the ASTM-1384 test method. All the formulations were evaluated in duplicate.

The results are given in Table 2 which shows that the quenchant fluid of Example 1 has acceptable metal corrosion properties.

TABLE 2

| Metal | Average weight losses (mg/specimen) First run | Second run | (for comparison) A commercial nitrite-containing quenchant BQA |
|---|---|---|---|
| Brass | 1 | 1 | 5 |
| Cast Iron | 1 | 0 | 0 |
| Steel | 0 | 0 | +3 |
| Aluminium | 20[1] | 30[1] | 5 |

[1]No pitting of the aluminium was observed.

The positive figure indicates a film formation on the surface of the specimen.

I claim:

1. A method of quenching a heated metal which comprises immersing the heated metal in a bath of aqueous metal quenchant fluid comprising water, a polyalkyene glycol and an inhibitor which is a soluble product obtained by mixing a dicaroxylic acid having 4 to 12 carbon atoms in the molecule, an amine which has a boiling point above 150° C. at atmospheric pressure, and which gives a soluble salt with the dicarboxylic acid, and an aromatic triazole copper chelating agent.

2. A method as claimed in claim 1, wherein the dicarboxylic acid has 8 to 12 carbon atoms in the molecule.

3. A method as claimed in claim 1, wherein the copper chelating agent is an aromatic triazole of sufficient solubility in water to provide an effective inhibitor.

4. A method as claimed in claim 1, where the relative amounts of dicarboxylic acid and amine are such that the pH is in the range 7.5 to 10.0.

5. A method as claimed in claim 1 wherein the heated metal is a ferrous metal.

6. A method as claimed in claim 5 wherein the initial temperature of the ferrous metal is between 750° and 800° C. and the bath of aqueous metal quenchant fluid is at a temperature between 20° and 25° C.

7. A method as claimed in claim 1 wherein the amine which has a boiling point above 150° C. at atmospheric pressure is an alkanolamine.

8. A method as claimed in claim 7 wherein the alkanolamine is selected from monoisopropanolamine, diethanolamine, triethanolamine and triisopropanolamino.

9. A method as claimed in claim 1 wherein the aromatic triazole, copper chelating agent is N,N - (diethanol) methylene benzotriazole.

10. A method as claimed in claim 1 wherein the dicarboxylic acid having 4 to 12 carbon atoms in the molecule is sebacic acid.

11. A method as claimed in claim 1 wherein the aqueous metal quenchant fluid is one which contains no added alkali metal nitrites.

12. A method as claimed in claim 1 wherein the aromatic triazole, copper chelating agent is N,N - (diethanol) methylene tolutriazole.

* * * * *